US012163344B2

(12) United States Patent
Furlani et al.

(10) Patent No.: US 12,163,344 B2
(45) Date of Patent: Dec. 10, 2024

(54) CLIMBING FORMWORK SYSTEM FOR MASS CONCRETE CONSTRUCTION, IN PARTICULAR FOR BUILDING A DAM OR FOR HYDROPOWER INDUSTRY, AND A METHOD FOR BUILDING A MASS CONCRETE CONSTRUCTION

(71) Applicant: SIMEM S.p.A., Minerbe (IT)

(72) Inventors: Federico Furlani, Minerbe (IT); Chris Hicks, Minerbe (IT); Michele Furlani, Minerbe (IT)

(73) Assignee: SIMEM S.p.A., Minerbe (IT)

( * ) Notice: Subject to any disclaimer, the term of this patent is extended or adjusted under 35 U.S.C. 154(b) by 93 days.

(21) Appl. No.: 17/791,819

(22) PCT Filed: Jan. 8, 2020

(86) PCT No.: PCT/IB2020/050116

§ 371 (c)(1),
(2) Date: Jul. 8, 2022

(87) PCT Pub. No.: WO2021/140359

PCT Pub. Date: Jul. 15, 2021

(65) Prior Publication Data

US 2023/0046180 A1 Feb. 16, 2023

(51) Int. Cl.

| | |
|---|---|
| ***E04G 11/28*** | (2006.01) |
| ***E02B 7/08*** | (2006.01) |
| ***E04G 11/22*** | (2006.01) |

(52) U.S. Cl.
CPC ..... *E04G 11/28* (2013.01); *E02B 7/08* (2013.01)

(58) Field of Classification Search
CPC ..... E04G 11/22; E04G 11/28; E02B 7/08
See application file for complete search history.

(56) References Cited

U.S. PATENT DOCUMENTS 676,785 A * 6/1901 Toelpe ..... E04G 11/28 249/40
3,497,579 A * 2/1970 Barron ..... E04G 11/22 425/111

(Continued)

FOREIGN PATENT DOCUMENTS

FR 972190 A 1/1951
JP H0517924 A 1/1993

OTHER PUBLICATIONS

International Search Report for PCT Application PCT/IB2020/050116, Sep. 4, 2020, 3 pages.

*Primary Examiner* — Benjamin F Fiorello
*Assistant Examiner* — Stacy N Lawson
(74) *Attorney, Agent, or Firm* — FERENCE & ASSOCIATES LLC

(57) ABSTRACT

A climbing formwork system for mass concrete construction comprises a movable panel separating a filling volume from an external environment, a track extending along a longitudinal direction partially inside said filling volume with a sliding channel closed with respect to the filling volume and a longitudinal slit facing the external environment. In addition, the climbing formwork system comprises a climbing element positioned and slidingly inserted in the sliding channel having a connection portion projecting through the slit to be connected with a portion of the movable panel. Fastening elements are operatively connected between the connection portion of the climbing element and the movable panel in order to maintain the latter fixed to the climbing element in a union condition. Also, a subject of this patent application is a method for building a mass concrete construction.

19 Claims, 6 Drawing Sheets

(56) References Cited

U.S. PATENT DOCUMENTS

| | | | | |
|---|---|---|---|---|
| 2006/0179756 | A1* | 8/2006 | McGregor | E04G 11/14 52/426 |
| 2008/0224022 | A1* | 9/2008 | Kreiner | E04G 11/22 52/745.01 |

* cited by examiner

CLIMBING FORMWORK SYSTEM FOR MASS CONCRETE CONSTRUCTION, IN PARTICULAR FOR BUILDING A DAM OR FOR HYDROPOWER INDUSTRY, AND A METHOD FOR BUILDING A MASS CONCRETE CONSTRUCTION

The present application is a National Phase Entry of PCT International Application No. PCT/IB2020/050116, which was filed on Jan. 8, 2020, the contents of which is hereby incorporated by reference.

TECHNICAL FIELD

The present invention relates to a climbing formwork system for mass concrete construction, in particular for building a dam or for hydropower industry.

Additionally, the invention relates to a method for building mass concrete structures in which the above-mentioned climbing formwork system is used.

BACKGROUND ART

Nowadays, the construction of mass concrete structures involves the use of one or more panels, eventually aligned each other, to provide formworks for the placement of concrete. These panels are arranged to define the shape of the structure under construction, for example a dam or other mass concrete structure, including hydroelectric power works.

Typically, these structures are built from bottom to top, layer by layer as the concrete placement progresses. When the first layer is completed, i.e. following the solidification of the concrete placed into the formwork, the formwork structure is removed, raised, and then reset to allow the start of layer above it, until the predefined height is reached.

In other words, a typical mass concrete production method comprises the following steps:

- setting of formworks (using crane and labor forces);
- installation of a formwork lateral force restraining system (form ties using labor forces);
- aligning formworks defining the shape of the first structure layer (using survey forces and labor forces);
- placing concrete inside the formworks (non-formwork activity);
- striking formworks (using labor forces);
- raising formworks (using crane and labor forces);
- setting formworks to reapply previous steps.

However, as derivable from the previous description, current mass concrete production methods are mainly discontinuous, i.e. they are defined by a plurality of clearly distinct passages from each other, resulting in discrete events and process that make up a larger method.

A principal drawback of a non-continual method is that the steps must be performed in a specified order that involve different resources and skills. So, the step wise process results in a discontinuous process with ample opportunity for work stoppage and delays, as well as adding process to prepare the concrete surface for the next concrete placement.

DISCLOSURE OF THE INVENTION

In this context, the technical task underlying the present invention is to propose a climbing formwork system for mass concrete construction, in particular for building a dam or for hydropower industry that overcomes the drawbacks of the prior art mentioned above.

In particular, it is an object of the present invention to provide a formwork system easily fixable during the production steps and, therefore, easily movable upwards during the construction of the structure.

Another object of the present invention is to provide a method for constructing a mass concrete structure which includes a sequence of continuous phases, i.e. a continuous process similar to an assembly line that does not stop, but rather is a continual process.

Particularly, a further object of the present invention is to provide a method wherein the concrete can be placed during the assembling, raising, and alignment of the formwork.

The specified technical task and specified purposes are substantially achieved by a climbing formwork system for mass concrete construction and by a method for building a mass concrete structure, which include the technical characteristics set out in the independent claims. The dependent claims correspond to further advantageous aspects of the invention.

It should be noted that this summary introduces a selection of concepts in simplified form, which will be further developed in the detailed description below.

The invention is directed to a climbing formwork system for mass concrete construction, in particular for building a dam or for hydropower industry.

The climbing formwork system comprises a movable panel which defines a wall of the climbing formwork system and, at the same time, it has an inner surface facing a filling volume of the climbing formwork system for containing the concrete and an outer surface facing an external environment.

The climbing formwork system also comprises a track which has a main extension along a longitudinal direction extending along a direction of climbing and, advantageously, it is positioned at least partially inside the filling volume of the climbing formwork system. Additionally, the track comprises a sliding channel, which is closed with respect to the filling volume, and a longitudinal slit extending along the longitudinal direction to realize a communication between the sliding channel and the external environment or the movable panel.

Advantageously, the track used for the movement and the alignment of the movable panel, it is also configured to provide an internally supported formwork lateral pressure resistance system. Whilst, prior art to perform the same technical solution needs to use an external supported form tie of the formwork system.

A climbing element is slidingly inserted and positioned in the sliding channel and is configured to slide or walk along the longitudinal direction, for example via a wheeled or geared supporting system. Preferably, the climbing element comprises a connection portion projecting through the slit to be connected with a portion of the movable panel.

Advantageously, fastening elements are operatively connected between the connection portion of the climbing element and the movable panel in order to maintain both fixed together in a union condition.

So, the climbing formwork system can then be easily positioned to delimit the filling volume V as it slides or walks along the track 5. In addition, it is also easily liftable for the preparation of a higher layer of the structure under construction and advantageously movable during the pouring of concrete in a continuous manner, without the need to interrupt the construction process. The invention is also directed to a method for building any mass concrete structure, in particular for a dam or for hydropower industry.

Specifically, the method comprises the following steps:

providing at least a climbing formwork system as previously described;

placing concrete inside the filling volume of the climbing formwork system in such a way that the concrete is contained by the movable panel itself;

raising the movable panel along the longitudinal direction to a second and subsequent positions by making the climbing element either slide or walk along the sliding channel.

Advantageously, the method allows a more continuous process similar to an assembly line that does not stop.

In addition, the raising of the climbing formwork system 1 is continuous so that the placement of concrete does not have to stop, allowing the concrete to be placed while the climbing formwork system 1 raises.

BRIEF DESCRIPTION OF DRAWINGS

Additional features and advantages of the present invention will become more evident from the approximate and thus non-limiting description of a preferred but non-exclusive embodiment of a climbing formwork system for mass concrete construction, as illustrated in the appended drawings, in which.

With reference to the drawings, they serve solely to illustrate embodiments of the invention with the aim of better clarifying, in combination with the description, the inventive principles of the invention.

DETAILED DESCRIPTION OF PREFERRED EMBODIMENTS OF THE INVENTION

The present invention refers to a climbing formwork system for mass concrete construction and a method for building a mass concrete construction.

With reference to the Figures, a climbing formwork system for mass concrete construction has been generically denoted with the number 1.

The other numerical references refer to technical features of the invention which, except for various indications or evident structural incompatibilities, the person skilled in the art will know how to apply to all the variant embodiments described.

Figure 1:
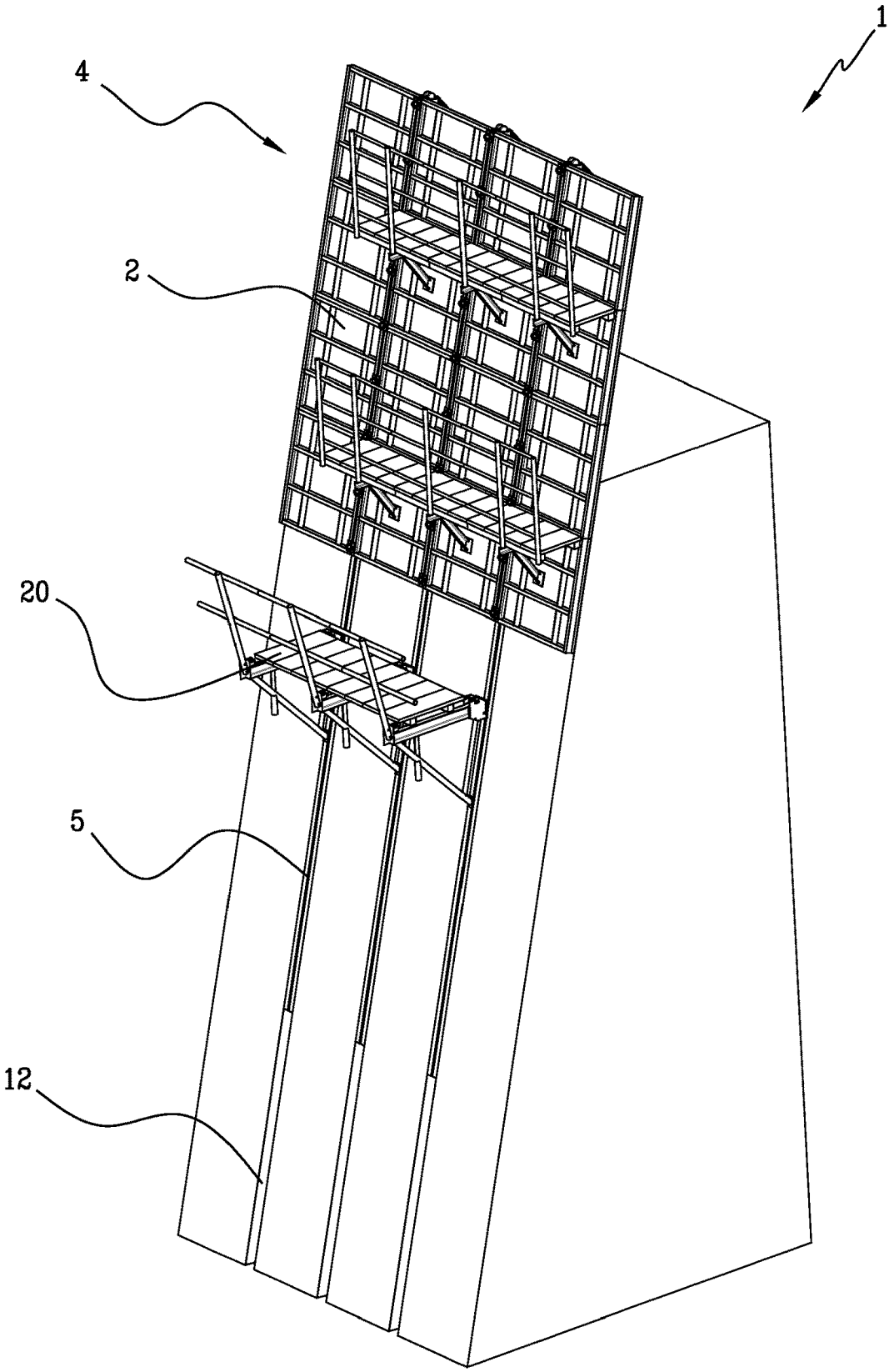
FIG. 1 illustrates a perspective view of a climbing formwork system for mass concrete construction.

As shown in FIG. 1, in accordance with the invention, a climbing formwork system 1 for mass concrete construction, in particular for building a dam or for hydropower industry.

Particularly, the climbing formwork system 1 comprises a movable panel 2 which defines a wall of the climbing formwork system 1 having an inner surface 3 facing a filling volume V of the climbing formwork system 1 for containing the concrete and an outer surface 4 facing an external environment.

The climbing formwork system also comprises a track 5 which has a main extension along a longitudinal direction L extending along a direction of climbing being positioned at least partially inside the filling volume V of the climbing formwork system 1. In addition, the track 5 comprises a sliding channel 6 closed with respect to the filling volume V and having a longitudinal slit 7 which extends along the longitudinal direction L. Preferably, the slit 7 is configured to realize a communication between the sliding channel 6 and the external environment or the movable panel 2.

A climbing element 8 is slidingly inserted and positioned in the sliding channel 6 to slide along the longitudinal direction L. The climbing element 8 comprises a connection portion 9 projecting through the slit 7 configured to be connected with a portion of the movable panel 2.

According to an aspect of the invention, fastening elements 10 are operatively connected between the connection portion 9 of the climbing element 8 and the movable panel 2 in order to maintain the latter fixed to said climbing element 8 in a union condition.

In other words, the fastening elements 10 guarantee the connection between the movable panel 2 and the climbing element 8 both during the movement of the same movable panel 2 along the track 5 and during its maintenance in a static position.

According to an aspect of the present invention, as shown in FIG. 1, the climbing formwork system 1 comprises a plurality of movable panels 2 arranged side by side along a transversal direction to the longitudinal direction L.

Preferably, one or more tracks 5 are interposed between two consecutive movable panels 2, in contact with both the respective inner surfaces 3, to overlap the space between the same movable panels 2 and to define a single continuous inner surface 3.

In this way, each track 5 is advantageously able to prevent the concrete from filtering between the movable panels 2 outside to the external environment. At the same time, slit 7 of each track 5 are disposed at the space comprised between two movable panels 2 for the projection to the external environment of the connection portion 9 of the climbing element 8. In fact, the connection portion 9, though the fastening elements 10, is configured to keep together the movable panels 2 with the climbing element 8 in the union condition, preferably fixing itself on the respective outer surfaces 4.

According to another aspect of the invention, the climbing formwork system 1 comprises a plurality of climbing elements 8 slidingly interposed for each track 5. At least, for each track 5 a climbing element 8 is disposed at the top portion of the movable panel 2, while a further climbing element 8 is disposed at the bottom portion of the movable panel 2.

Figure 2:
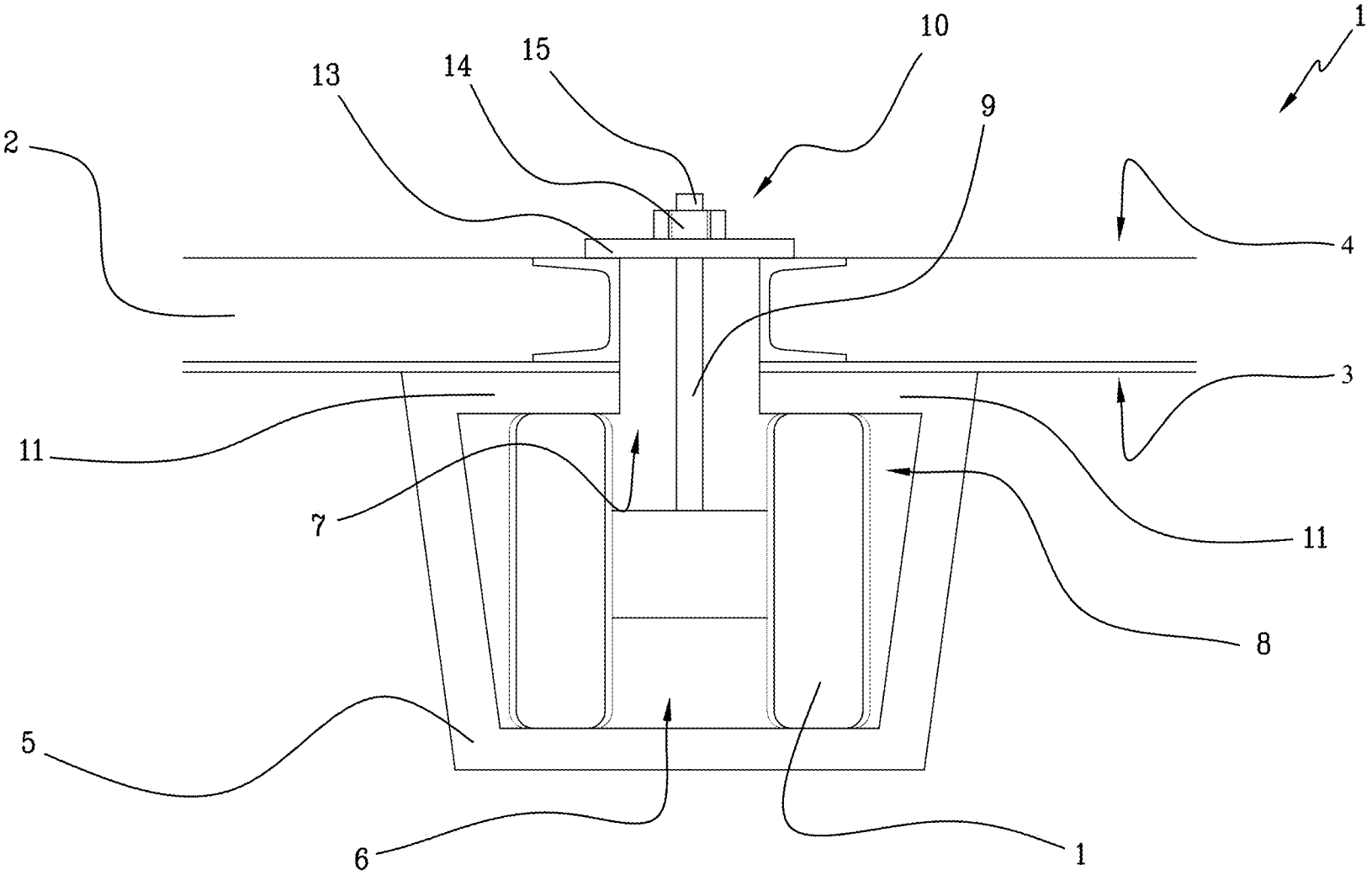
FIG. 2 illustrates a top-section view of a portion of the climbing formwork system shown in FIG. 1.

According to an aspect of the present invention, as shown in FIG. 2, the track 5 has a substantially "C-shaped" orthogonal section, with respect to the longitudinal direction L, so the slit 7 is realized between two opposite legs 11 of the "C-shape".

In other words, the track 5 has a "C" shaped side wall that is almost completely closed on itself due to the contrast of two opposite appendages facing each other, said two legs 11. In other words, the slit 7 is therefore the free space between these two appendages, for the whole length of the track 5 along the longitudinal direction L.

According to another aspect of the invention, the slit 7 is realized at the centre between the two opposite legs 11, being symmetrically shaped and lying on a median plane of the track 5, which is parallel to the longitudinal direction L. So, preferably, the "C" shape of the track 5 is symmetrical with respect of a median plane.

According to a further aspect of the invention, the track 5 has a trapezoidal cross-section, respect with the longitudinal direction L, with a larger base facing the removable panel 2 so that the same track 5 is easily removable from the concrete when solidified. As shown in FIG. 1, the portion of the building under construction, i.e. the solidified concrete portion, has grooves 12 extending along the longitudinal direction L, below the respective tracks 5. As explained in more detail later in the description, after the concrete has solidified, the track 5 are removed to be installed as an extension of further track 5 (previously prepared—always along the longitudinal direction L). As a result, grooves 12 are formed along the outer wall of the concrete of the building under construction, as shown in FIG. 1.

According to an aspect of the invention, the fastening elements 10 in the union condition are configured to arrange the climbing element 8 against the two legs 11 and, at the same time, to arrange the two legs 11 against the movable panel 2 so that the two legs 11 can define a sliding surface for the sliding of the climbing element 8 along the longitudinal direction L.

The fastening elements 10 join the climbing element 8, the track 5 and the moving panel 2 as a single body. In addition, the weight of the movable panel 2 is such that the climbing element 8 compresses itself against the inside of the side wall of the track 5 (more precisely, according to one aspect of the invention, the pressure is applied to the opposite two legs 11). This, advantageously, means that the friction generated between the climbing element 8 and the track is such as to allow the movement along the longitudinal direction L or (in the case of a really high friction) to prevent the movement of the movable panel 2 (as better described below).

According to another aspect of the invention, the climbing formwork system 1 comprises a movement device (not shown) associated with the climbing element 8 to configure the latter between a movement condition, in which it is able to slide along the longitudinal direction L for moving the movable panel 2 along the track 5, and a stoppage condition, in which it is maintained in a static position with respect to the track 5 for keeping in place the movable panel 2.

For example, the movement device may include a crane configured to connect to an upper portion of the movable panel 2 or the climbing element 8 to lift the climbing formwork system 1 from above. Alternatively, at ground or other level convenient with the position of the climbing formwork system 1, there may be a hydraulic piston, or a similar means, connected to the movable panel 2 or to the climbing element 8 to push it from below and raise it in either an incremental of continuous manner. Finally, the climbing element 8 may include motors, e.g. electric motors, which enable or disable its movement along the sliding channel 6 of the track 5.

According to an aspect of the invention, the movement device is realized through the fastening elements 10. In other words, in the movement condition the fastening elements 10 are configured to generate between the climbing element 8 and the movable panel 2 a friction force to keep them together and, at the same time, to allow the movement along the longitudinal direction L. Whilst, in the stoppage condition the fastening elements 10 are configured to generate between the climbing element 8 and the movable panel 2 a friction force high enough to prevent the movement along the longitudinal direction L.

According to a further aspect of the invention, the climbing formwork system 1 comprises another climbing element 8 configured as a friction clamp to act in union with the track 5 when the system is required to maintain a constant fixed position.

Figure 5:
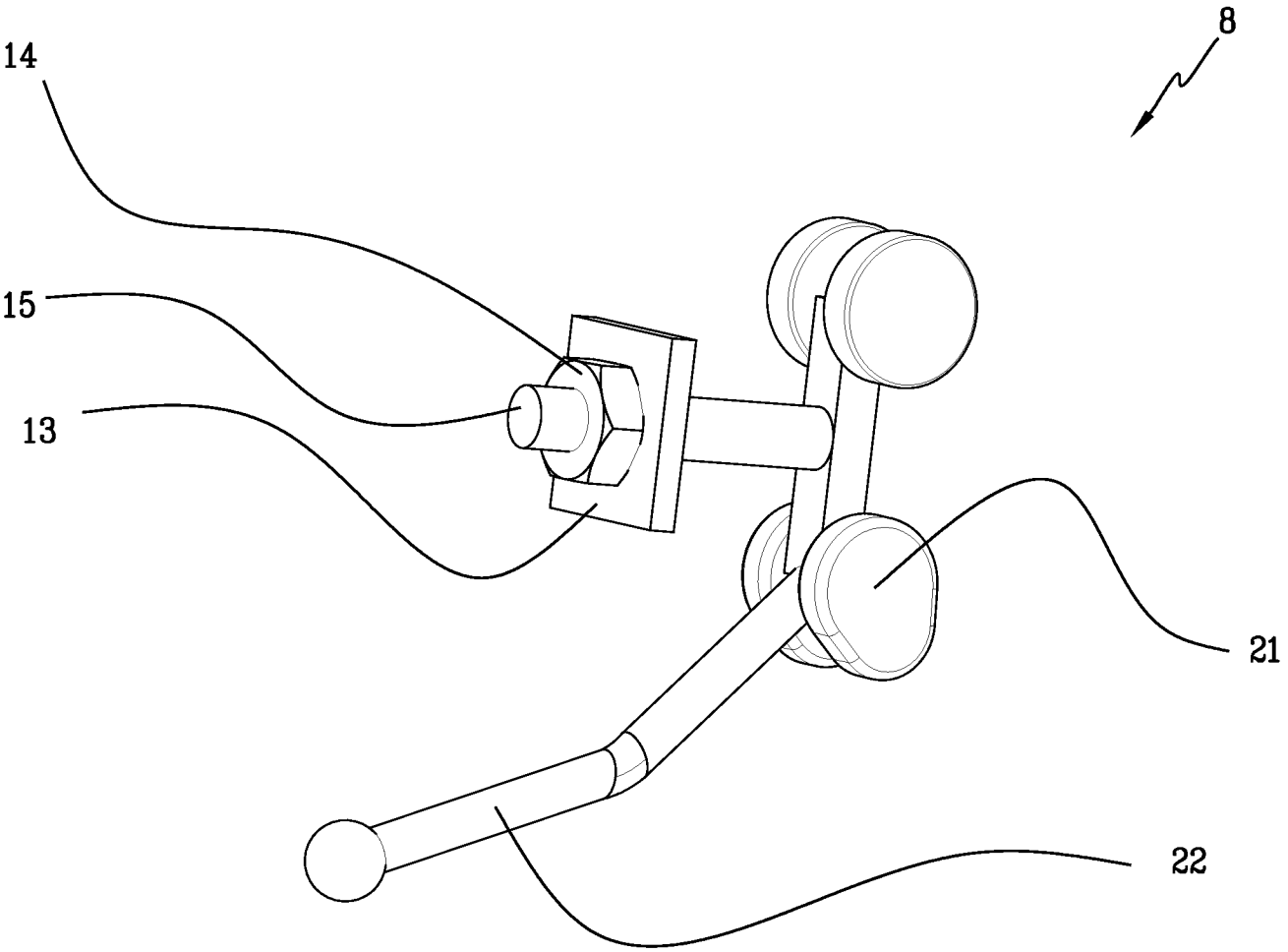
FIG. 5 illustrates a further embodiment of the climbing element

FIG. 5 shows a possible embodiment of the climbing element 8 configured as a friction clamp. According to this embodiment, the climbing element 8 comprises at least an eccentric wheel 21 configured to slide (without rotating because of it is eccentric) along the sliding channel 6 of the track 5 in which it is inserted. When it is necessary to lock the movable panel 2 in a static position, the eccentric wheel 21 can be manually rotated by a lever 22 connected to it. So, in this way the main axis of the eccentric wheel 21 is disposed transversally to the longitudinal direction L of the track 5 and, consequently, the eccentric wheel 21 acts as a friction element.

According to another aspect of the invention better shown in FIGS. 2-5, the connection portion 9 of the climbing element 8 comprises a plate 13 bondable to a portion of the movable panel 2, for example through at least a bolt 14, in correspondence of the inner surface 3 or of the outer surface 4.

According to a preferred embodiment of the invention shown in FIG. 2, the track 5 is disposed in contact with the inner surface 3 of the movable panel 2 and, at the same time, the slit 7 is only partially covered by the same inner surface 3. So, the plate 3 is fixed to a portion of the outer surface 4 of the movable panel. In addition, the track 5 defines a lateral extension of the movable panel 2 along a lateral edge of the same movable panel 2.

Figure 3:
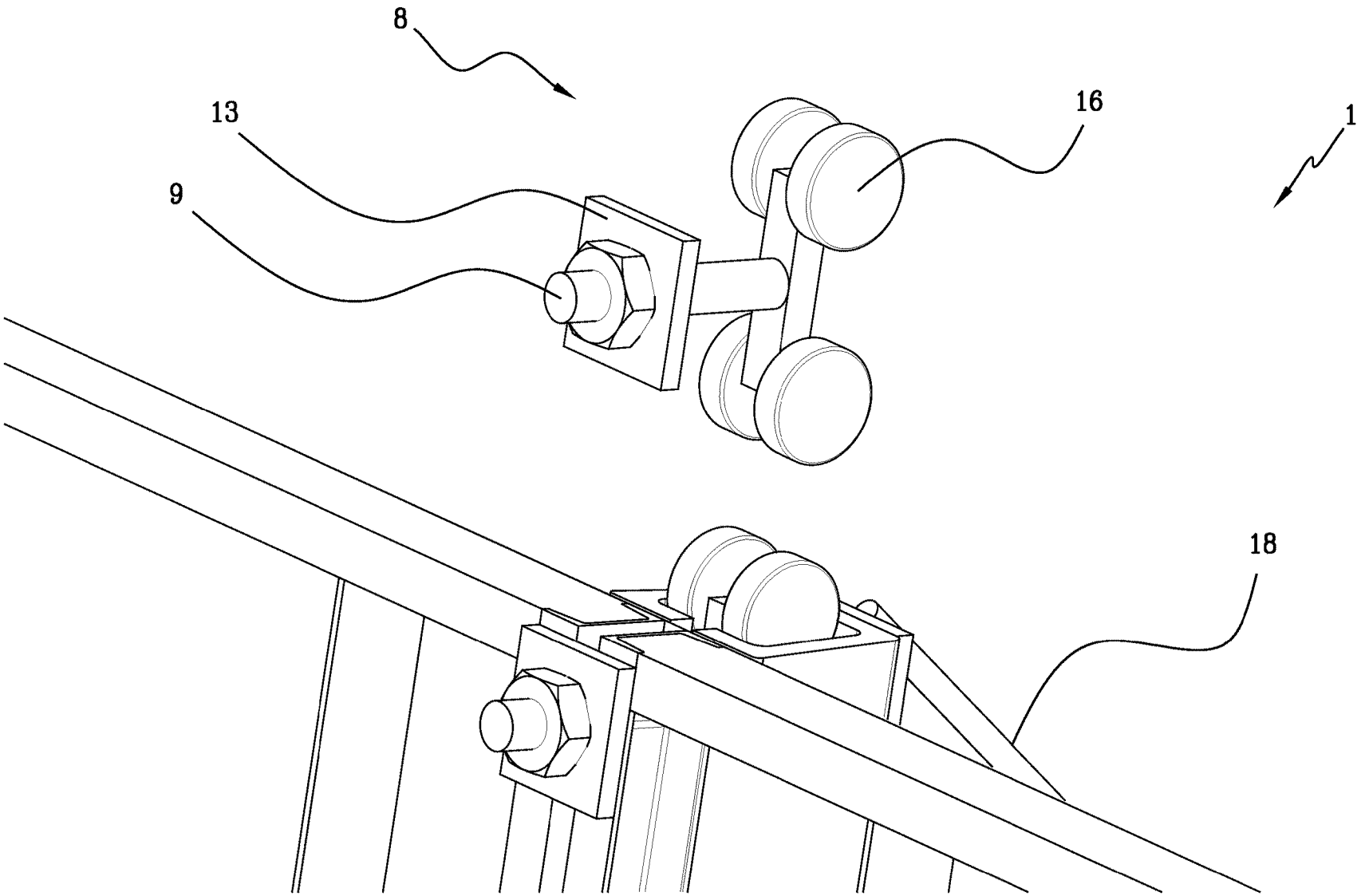
FIG. 3 illustrates a first embodiment of the climbing element.
Figure 4:
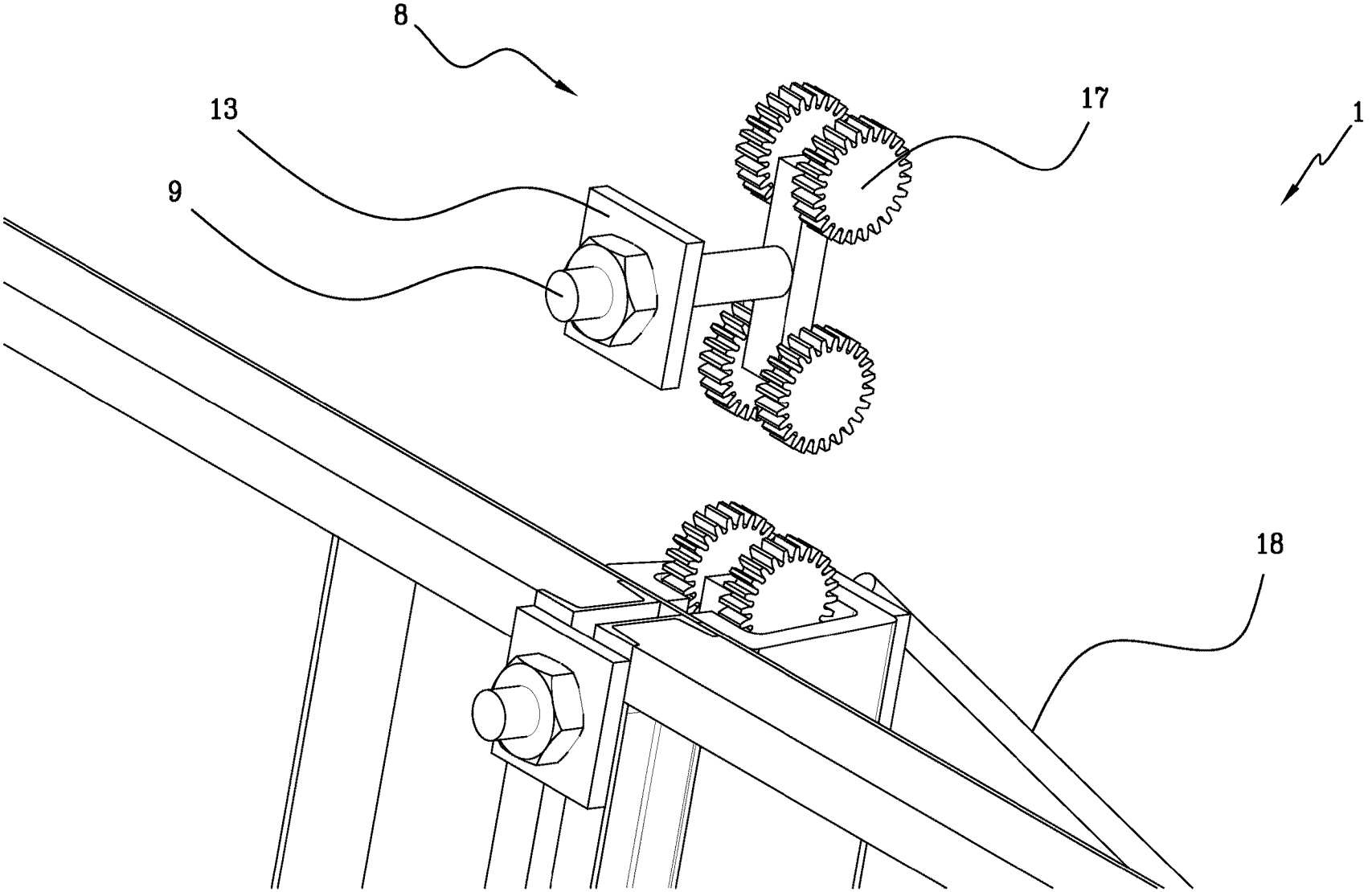
FIG. 4 illustrates a second embodiment of the climbing element.

More precisely, as shown in FIGS. 3-5, the connection portion 9 is essentially a bolt 14 projecting to the external environment through the space between the two movable panels 2. The plate 13, displaced against the outer surfaces 4 of the movable panels 2, is perforated so as to be supported by the bolt 14 and is held in place with the use of a nut 15.

The plate 13, the bolt 14 and the nut 15 form the fastening elements 10. In this way, it is possible to determine the movement condition or the stoppage condition by adjusting the force with which the nut 15 tightens the plate 13 against the movable panels 2.

Advantageously, the track 5 prevents liquid concrete from penetrating through the space between the movable panels 2, ensuring that the climbing formwork system 1 is tight and that the building's concrete block (i.e. its layer) is formed.

According to an embodiment of the invention not shown, the track 5 is disposed in contact with the inner surface 3 of the movable panel 2 and the slit 7 is faced and totally covered by the same inner surface 3. So, the plate 13 is fixed to a portion of the inner surface 3 with the interposition of bolts 14 or tools with the same purpose.

FIG. 3 shows a first embodiment of the invention, wherein the climbing element 8 comprises at least one wheel 16, preferably four wheels 16, shaped to slide freely along the sliding channel 6.

Each wheel 16 is shaped in such a way that it can be easily rotated inside the sliding channel 6 so that the climbing element 8 can slide along the longitudinal direction L. Preferably, each wheel 16 is in contact with only one portion of the track 5, preferably one of the two opposite legs 11, so as to generate sufficient friction for its rotation and, thus, the movement of the movable panel 2 (or alternatively a friction high enough to prevent movement in both directions).

FIG. 4 shows a second embodiment of the invention, wherein the climbing element 8 comprises at least one gear 17, preferably four gear 17, shaped to slide freely along the sliding channel 6.

According to an aspect of the invention, the track 5 comprises a rack (not shown) disposed along the sliding channel 6 and counter shaped with the gear 17 for allowing its sliding on it along the longitudinal direction L or to stop the movement for keeping in a static position the movable panel 2.

Figure 6:
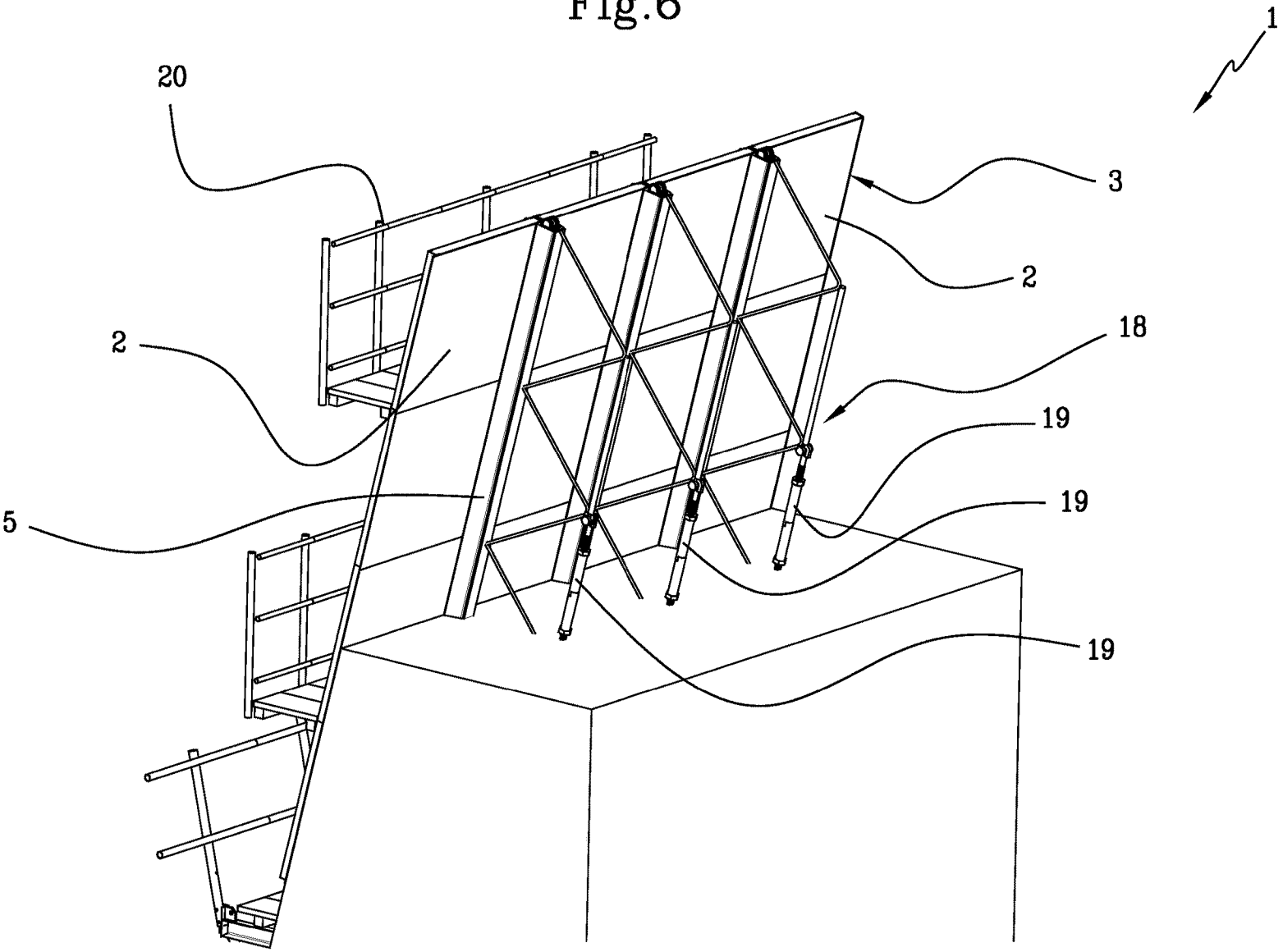
FIG. 6 illustrates a back view of the climbing formwork system shown in FIG. 1.

According to another aspect of the invention, the rack is disposed along at least one of the two opposite legs 11. Preferably, for the entire length of each legs 11 there is a rack for the sliding of at least a respective gear 17. FIG. 6 shows a back view of a climbing formwork system 1 which comprises a support frame 18 and/or a truss connected to the track 5 and disposed at least partially inside the filling volume V.

The support frame 18, being placed inside the filling volume V, following the solidification of the concrete, will be incorporated into the structure, and therefore not removable unlike the track 5 that can be recovered later.

According to an aspect of the invention, the support frame 18 comprises at least an actuator 19, for example a turnbuckle, configured to merge the support frame 18 with a possible additional support frame 18.

In this way, the actuator 19 is able to compensate for any misalignments or variable distances that may be present between the various uprights of such support frames 18.

According to another aspect of the invention, the actuator 19 is configured to modify its own length to vary the inclination between two consecutive support frames 18 and/or to adapt to the distance between two consecutive support frames 18.

Advantageously, being configured to vary its length (increasing or decreasing it), the actuator 19 is able to bring the support frames 18 closer or further apart, thus changing the reciprocal inclination and, therefore, the inclination of the movable panel 2.

According to an aspect of the invention, the support frame 18 (shaped as beam/truss) is configured to resist the lateral forces on the movable panel 2 as the fresh concrete is placed. This happens when the support frame 18 is continually encased in concrete below and integrally connected in union with subsequent additional actuators 19 and other additional support frame 18 members extending below into, previously placed and hardened concrete. The support frames 18 can be either designed as a beam or a truss member depending on the required lateral force to resist. The support frames 18 acts in a continuous manner to transfer lateral concrete pressure to members below encased in previously hardened concrete.

According to an aspect of the invention, the support frame 18 provided is configured to transfer a lateral force below into previously placed and hardened concrete. Additionally, the support frame 18 provides a support system for the climbing formwork system 1 to remain in the desired location during the concrete placement.

According to an aspect of the invention, this internal transferring of loads allows for an internal support system rather than an external support system for the lateral fluid pressure loads encountered during placement of the concrete.

As shown in FIG. 1, any scaffolding and/or walkways 20 can be installed on the outer surface 4 of the movable panel 2, and are therefore able to slide with it, or they include a support system slidingly inserted into the track 5 not yet removed after the raising of the movable panel 2. In this way the track 5 has multiple purposes.

The present invention is also addressed to a method for building a mass concrete structure, which is also directly derivable from what is described above.

The method for building a mass concrete structure, in particular for a dam or for hydropower industry, comprises steps of:

- providing at least a climbing formwork system 1 as previously described;
- placing the movable panel 2 in a first position to define said filling volume V;
- pouring concrete inside the filling volume V of the climbing formwork system 1 in such a way that the concrete is contained by the movable panel 2 itself;
- raising the movable panel 2 along the longitudinal direction L to a second position by making the climbing element 8 sliding along the sliding channel 6, advantageously in either a continuous or discrete movement.

Advantageously, the movable panel 2 can be added (side, end, or abutment locations) if needed and incorporated into the climbing formwork system as progress is made.

According to an aspect of the invention, the method comprises further steps of:

- providing a further track 5 consecutive to the track 5 along the longitudinal direction L;
- raising the movable panel 2 along the longitudinal direction L to a static position on the further track 5;
- removing the track 5 from a portion of the building under construction;
- placing the track 5 removed consecutive to the further track 5 along the longitudinal direction L.

Advantageously, the raising of the movable panel 2 is continuous so that the placement of concrete does not have to stop. The concrete can be placed while the forms are being raised.

In detail, the present invention allows to change from a discrete stepwise formwork process to a continuous formwork process.

According to another aspect of the invention, the step of placing concrete and the step of raising the movable panel 2 are carried out simultaneously without interrupting the movement of the movable panel 2 during the pouring of concrete in the filling volume V of the climbing formwork system 1.

Advantageously, the alignment of the movable panels 2 is done through the continuous tie system and can be performed while simultaneously placing concrete.

Furthermore, formworks can be added (abutment locations) if needed and incorporated into the formwork system as progress is made.

The raising of the forms is also continuous so that the placement of concrete does not have to stop. Concrete can be placed while the forms are being raised.

The alignment of the forms is done through the continuous tie system and can be performed while simultaneously placing concrete.

Finally, the continuous support track/integral tie system also resists the lateral fluid pressure exerted during concrete placement and is allows for additional members to be installed while concrete is being placed.

The invention claimed is:

1. A climbing formwork system for mass concrete construction, in particular for building a dam or for hydropower industry, the climbing formwork system comprising:

- a movable panel defining a wall of the climbing formwork system; said movable panel having an inner surface facing a filling volume of the climbing formwork system for containing the concrete and an outer surface facing an external environment;

a track having a main extension along a longitudinal direction extending along a direction of climbing and positioned at least partially inside said filling volume of the climbing formwork system; said track comprising a sliding channel closed with respect to the filling volume and having a longitudinal slit extending along the longitudinal direction; said slit being configured to realize a communication between said sliding channel and said external environment or said movable panel, wherein said track is disposed in contact with said inner surface and said slit is at least partially covered by said inner surface; said track defining a lateral extension of said movable panel along a lateral edge of the same movable panel;

a climbing element slidingly inserted in said sliding channel and configured to slide along said longitudinal direction; said climbing element comprising a connection portion projecting through said slit and configured to be connected with a portion of said movable panel; and fastening elements operatively connected between said connection portion of the climbing element and the movable panel in order to maintain the movable panel fixed to the climbing element in a union condition, wherein said fastening elements comprise a plate fixed to a portion of said outer surface through at least a bolt.

2. A climbing formwork system according to claim 1, wherein an orthogonal section of said track, with respect to the longitudinal direction, is "C-shaped" so as to said slit is realized between two opposite legs of the "C-shape".

3. A climbing formwork system according to claim 2, wherein said slit is realized centered between said two opposite legs; said slit being symmetrically shaped and lying on a median plane of the track, which is parallel to said longitudinal direction.

4. A climbing formwork system according to claim 2, wherein said track has a trapezoidal cross-section, with respect to said longitudinal direction, with a larger base facing the movable panel so that the track is removable from the concrete when solidified.

5. A climbing formwork system according to claim 2, wherein said fastening elements in the union condition are configured to arrange said climbing element against said two legs and to arrange said two legs against said movable panel so that said two legs define a sliding surface for the sliding of said climbing element along said longitudinal direction.

6. A climbing formwork system according to claim 1, comprising a movement device associated with said climbing element to configure the latter between a movement condition, in which the climbing element is able to slide along said longitudinal direction to move said movable panel along said track, and a stoppage condition, in which the climbing element is maintained in a static position with respect to said track to keep in place said movable panel.

7. A climbing formwork system according to claim 6, wherein said movement device is realized through said fastening elements; in the movement condition said fastening elements are configured to generate a friction force between said climbing element and said movable panel such as to allow movement along said longitudinal direction; in the stoppage condition said fastening elements are configured to generate a friction force between said climbing element and said movable panel such as to prevent movement along said longitudinal direction.

8. A climbing formwork system according to claim 1, wherein said climbing element comprises at least one wheel shaped to slide freely along said sliding channel.

9. A climbing formwork system according to claim 1, wherein said climbing element comprises at least one gear shaped to slide freely along said sliding channel.

10. A climbing formwork system according to claim 9, wherein said track comprises a rack disposed along said sliding channel; said at least one gear being configured to be coupled with said rack for sliding on said rack along said longitudinal direction.

11. A climbing formwork system according to claim 10, wherein an orthogonal section of said track, with respect to the longitudinal direction, is "C-shaped" such that said slit is realized between two opposite legs of the "C-shape", and wherein said rack is disposed along at least one of said two opposite legs.

12. A climbing formwork system according to claim 1, comprising a support frame connected to said track and disposed at least partially inside said filling volume.

13. A climbing formwork system according to claim 12, wherein said support frame comprises at least an actuator configured to merge said support frame with a possible additional support frame; said possible additional support frame being disposed above or below said support frame.

14. A climbing formwork system according to claim 13, wherein said actuator is configured to modify its own length to vary the inclination between two consecutive support frames and/or to adapt to the distance between two consecutive support frames.

15. A climbing formwork system according to claim 1, wherein the movable panel comprises a plurality of movable panels arranged side by side along a transversal direction to said longitudinal direction.

16. A climbing formwork system according to claim 15, wherein the plurality of movable panels comprises two consecutive movable panels and the track comprises one or more tracks interposed between the two consecutive movable panels, in contact with both the respective inner surfaces, to overlap the space between the same movable panels and to define a single continuous inner surface.

17. A climbing formwork system according to claim 1, wherein the climbing element comprises a plurality of climbing elements slidingly interposed for each track.

18. A method for building a mass concrete construction, in particular for a dam or for hydropower industry, the method comprising steps of:

providing at least a climbing formwork system which comprises:

a movable panel defining a wall of the climbing formwork system; said movable panel having an inner surface facing a filling volume of the climbing formwork system for containing the concrete and an outer surface facing an external environment;

a track having a main extension along a longitudinal direction extending along a direction of climbing and positioned at least partially inside said filling volume of the climbing formwork system; said track comprising a sliding channel closed with respect to the filling volume and having a longitudinal slit extending along the longitudinal direction; said slit being configured to realize a communication between said sliding channel and said external environment or said panel;

a climbing element slidingly inserted in said sliding channel and configured to slide along said longitudinal direction; said climbing element comprising a connection portion projecting through said slit and configured to be connected with a portion of said movable panel; and fastening elements operatively connected between said connection portion of the climbing element and the movable panel in order to maintain the movable panel fixed to the climbing element in a union condition;

placing the movable panel in a first position to define said filling volume;

pouring concrete inside said filling volume of the climbing formwork system in such a way that the concrete is contained by the movable panel itself, raising said movable panel along said longitudinal direction to a second position by making the climbing element slide along the sliding channel;

providing a further track consecutive to said track along said longitudinal direction;

raising said movable panel along said longitudinal direction to a static position on said further track;

removing said track from a portion of dam or hydropower industry produced; and placing said track removed consecutive to said further track along said longitudinal direction.

19. A method according to claim 18, wherein said step of placing concrete and said step of raising said movable panel are carried out simultaneously without interrupting the movement of the movable panel during the filling of concrete in the climbing formwork system.

* * * * *